United States Patent [19]

Baumann

[11] 4,367,771

[45] Jan. 11, 1983

[54] CONNECTING PART FOR ELECTRICAL WARP STOP MOTION ON WEAVING MACHINES

[75] Inventor: Hans Baumann, Horgen, Switzerland

[73] Assignee: Grob & Co. Aktiengesellschaft, Horgen, Switzerland

[21] Appl. No.: 192,858

[22] Filed: Oct. 1, 1980

[30] Foreign Application Priority Data

Oct. 2, 1979 [CH] Switzerland ..... 8856/79

[51] Int. Cl.[3] ..... C03D 51/28

[52] U.S. Cl. ..... 139/358; 139/369; 28/187

[58] Field of Search ..... 139/358, 369, 353; 28/187 R; 66/163; 200/61.18

[56] References Cited

U.S. PATENT DOCUMENTS

| | | | |
|---|---|---|---|
| 1,817,166 | 8/1931 | Payne | 139/358 |
| 2,479,546 | 8/1949 | Thatcher et al. | 139/358 |
| 2,587,409 | 2/1952 | Tuck | 139/358 |
| 4,321,951 | 3/1982 | Hintsch | 139/353 |

*Primary Examiner*—Henry Jaudon

*Attorney, Agent, or Firm*—Watson, Cole, Grindle & Watson

[57] ABSTRACT

The connecting part for electrical warp stop motions on weaving machines has two rectangular housing shells (2,3) pressed against each other at their open sides by means of a threaded pin (10) screwed into the first housing shell (2). The screw-head of the threaded pin is in the shape of a knob (11) and presses against the second housing shell (3). In the longitudinal sides (4,6) of both housing shells (2,3) are supporting slots (9) at equal distances to take up the contact bars. On the interior base (12,15) of each housing shell (2,3) is a strip (13,16) of elastic material and on each strip a contact foil (14,17) for conducting electricity to all the contact bars, the narrow edges of which have perfect contact with the contact foils, even at varying height resulting from deviations in manufacture, due to the elastic material under them. A plug pin (18), in the second housing shell (3) is in direct electrical contact to the contact foil (17) in this housing shell and a further plug pin (19) is electrically connected to the contact foil (14) in the first housing shell (2) by means of a rod (23) on the exterior of the longitudinal side of the second housing shell and by means of the screw-head (11) and the threaded pin (10).

6 Claims, 3 Drawing Figures

Fig. 1
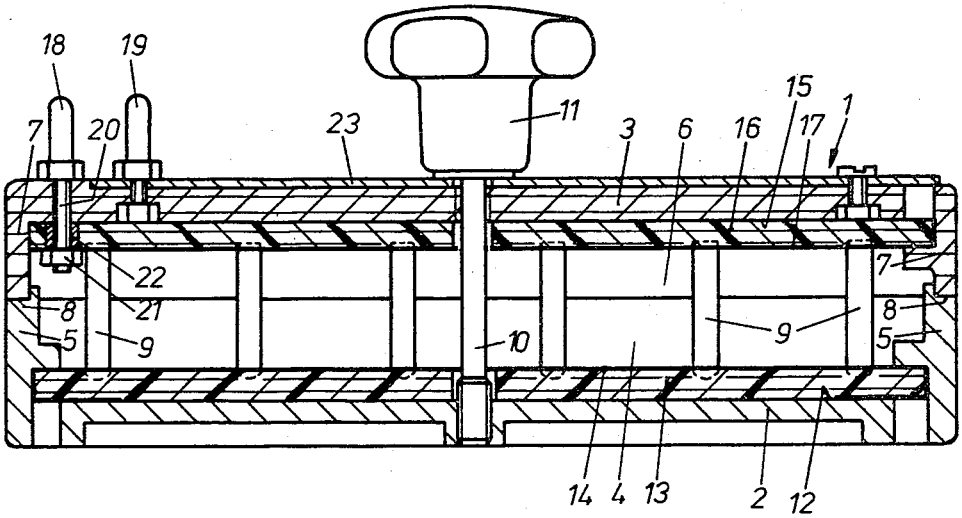
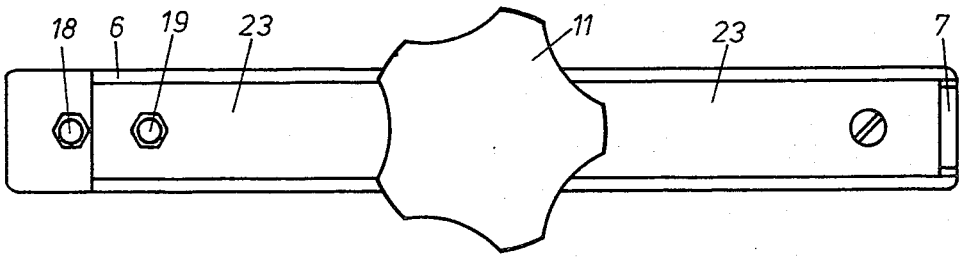
Fig. 2
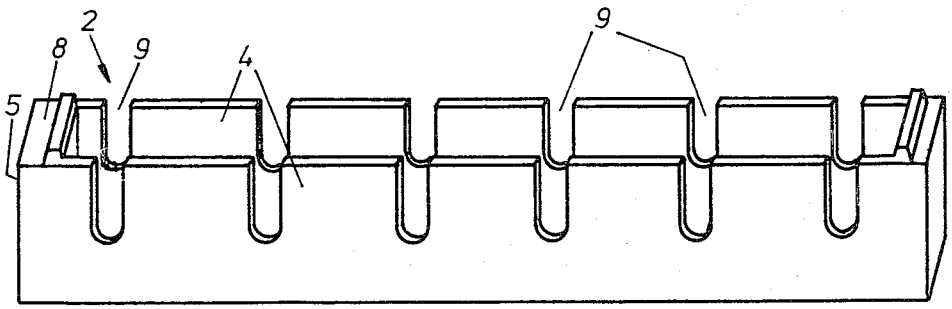
Fig. 3

CONNECTING PART FOR ELECTRICAL WARP STOP MOTION ON WEAVING MACHINES

BACKGROUND OF THE INVENTION

The invention concerns a connecting part for electrical warp stop motions on weaving machines, which serves to conduct electricity to several contact bars, positioned parallel to one another, and each consisting of two conductor bars insulated against each other.

As is known, electrical warp stop motions serve to close an electric current, in the event of a warp thread breaking, and thereby stop the weaving machine. The electric current is closed by means of the drop wires resting on the warp threads. When a warp thread breaks, the drop wire falls on to its corresponding contact bar and thereby electrically connects the two conductor bars of this contact bar. Usually each contact bar consists of an outer, U-shaped conductor bar and an inner, flat conductor bar with an insulation between them, whereby the inner conductor bar has a protruding narrow edge against which the slanted top edge of the contact bar slot of the drop wire hits.

All the inner and outer conductor bars of the contact bars positioned parallel to each other must be connected, in parallel position, to an electrical source. This is done by means of the connecting part. The connecting part should be easily mountable and removable by hand to allow for easy insertion of the contact bars into the warp stop motion when, for instance, a new warp is gated. There are various known executions of connecting parts of which one part, consisting of insulating material, evidences parallel slots to accommodate the contact bars. Either an electrical conductor, stretching across all the slots and touching all the inner conductor bars, is screwed to the part consisting of insulating material and the outer conductor bars resting in the slots of the mentioned part are connected to a further electrical conductor serving both, the disadvantage of which is that every time the contact bars are inserted or removed, all the screws have to be loosened. Or, as in another type of execution, the connecting part, mountable from above on to all the contact bars, has a lengthwise part consisting of insulating material and having slots. This part is foreseen with a slider, moveable in longitudinal direction by means of spring action, and having the same number of downwards reaching fingers with hook shaped ends, as there are slots. The fingers grip around the under edges of all the contact bars when the slotted part, consisting of insulating material, is mounted on the upper edges of all the contact bars. This connecting part is mountable on to all the contact bars in one easy motion of the hand. In the case of every slot there are moveable contact pins against which each inner conductor bar of each contact bar rests and, furthermore, conducting stirrups, that reach to the end of every slot and overlap the U-shaped outer contact bars. The many springy contact pins and conducting stirrups, which are electrically connected to each other by means of the electric conductor reaching across the length of the connecting part and which are connected to contacts in the form of plug pins, as well as the holder with fingers having hook-shaped ends, make this practical and handy connecting part relatively expensive to manufacture.

The object of the present invention, therefore is to eliminate the disadvantage of the relatively involved construction evidenced in the price, as well as the further disadvantage which is that, due to the oscillations and the shaking of the weaving machine in operation, this described known connecting part, consisting of many individual parts, is subject to relatively severe wear and tear. A connecting part, simpler in construction and consisting of fewer parts than the mentioned one, must however, just as the known and above-described connecting part, fulfill the prerequisite that every contact bar is in springy contact with the electrical conductor in the connecting part that connects each to the other. This prerequisite is met in the above described known connecting part by means of the mentioned springy contact pins and is unavoidable due to the manufacturing tolerances of the contact bars that may differ up to 1 mm in upright measurement. A non-springy contact, therefore, would make the functioning of the connecting part questionable, all the more so, in view of the oscillations of the running weaving machine which are transferred to the connecting part.

SUMMARY OF THE INVENTION

In order to meet the given task, the connecting part as described at the beginning is characterized in that a first and a second housing shell, each with two longitudinal and two side frames and with supporting slots at equal distances to take up the contact bars, are pressed against each other by means of a securing device, and that on the interior bases of both housing shells, there is fastened a strip of elastic material, covered by a contact foil for conducting electricity to all the contact bars, whereby the complementary distance between the contact foils is less than the length of the contact bar supporting slots reaching between them, and that the terminal contacts on the exterior of one housing shell are electrically connected to one each of the two contact foils on the interior bases of both housing shells.

In an appropriate embodiment, the securing device pressing both housing shells against each other is a threaded pin screwed into the base of one housing shell and reaching through the opposite housing shell to its exterior, and having its screw-head in the form of a knob that presses against the exterior of one housing shell when the threaded pin is screwed in. In a preferred further embodiment, one housing shell consists of electrically conducting material and the other, of non-conducting material. The threaded pin, screwed into the housing shell of electrically conducting material is a conductor for the electrical contact between the contact foil which is in surface contact with its housing shell and with a terminal contact on the exterior of the housing shell of non-conducting material.

Finally, in a favoured manner, the threaded pin is situated on the longitudinal centre of the housing shell and the terminal contacts are placed close to one end on the exterior of the housing shell of non-conducting material and are at lateral distance to the threaded pin. This housing shell has a rod on the mentioned exterior through which the threaded pin reaches and this rod is an electrical conductor between the screw head, pressing against the rod when the threaded pin is screwed in, and one of the terminal contacts, which is on the mentioned exterior of the housing shell and securely fastened to the rod.

This embodiment results in a connecting part consisting of few parts and that can be manufactured at low cost; on which the strip of elastic material between the base of the housing shell and the contact foil covering the strip and electrically connecting all the contact bars, functions as the necessary springy element to compensate the varying manufacturing tolerances of the contact bars. The strip is appropriately of a caoutchouc-elastic synthetic material such as, for instance, "Vulkollan", but can consist of any other material having similar properties.

A further advantage of this connecting part is that it does not consist of the many moveable parts as does the known and afore-described connecting part, and is therefore not subject to the wear and tear resulting from the oscillation and shaking of the operating weaving machine. This connecting part, therefore, contributes to increased economy through longer life.

Further details and advantages of the invention will be seen from the following description and the drawings which show, by way of example, one embodiment of the inventive connecting part.

DESCRIPTION OF THE DRAWINGS

FIG. 1 shows a longitudinal section of one embodiment of a connecting part according to the present invention;

FIG. 2 shows a plan view of the connecting part shown in FIG. 1; and

FIG. 3 shows a perspective view of the bottom housing shell of the inventive connecting part.

DETAILED DESCRIPTION OF THE PREFERRED EMBODIMENT

The connecting part, designated as 1 in the drawing, includes a housing shell 2 and a second housing shell 3, which, in the drawing constitute a bottom and a top housing shell and are of rectangular shape, so that they fit against each other on their open sides. The first housing shell 2 has two longitudinal walls 4, of which only one can be seen in the longitudinal section, and has two narrow-side walls 5 opposite each other forming a shell-shaped body together with the longitudinal side walls.

The second housing shell 3 also has two longitudinal walls 6 and two narrow-side walls 7. The two narrow-side walls 5 of the first housing shell 2 have a staggered edge 8 at the top, on which the second housing shell 3 is placed like a cover and is secured against lateral displacing.

In the two longitudinal sides 4 of the first housing shell 2 and the longitudinal sides 6 of the second housing shell 3, there are supporting slots 9, at equal distances from one another and in true alignment along the two longitudinal sides 4 and 6 of both housing shells, that serve to take up the contact bars (not shown in the drawing).

The two housing shells 2 and 3 are pressed together by means of a threaded pin 10, placed at the longitudinal centre, and which is screwed into the lower housing shell 2 and its screw-head, in the shape of a knob 11 presses against the exterior of the upper housing shell. The lower housing shell 2 consists of an electrically conducting material and the upper housing shell 3 consists of a non-conducting material.

On the interior of the base 12 of the lower housing shell 2 is a strip 13 of elastic material along the entire length of the base surface. This strip consists of a caoutchouc-elastic synthetic material on a Polyurethane basis, which in the context of the given demands, has proved best. On the strip 13 of elastic material there is a contact foil 14 that completely covers the strip 13 and folds around both the narrow-side edges of the strip 13 towards the opposite ends so that the contact foil is firmly held in this manner and is in electrically-conducting contact with the lower housing shell.

In the same manner, a strip 16 of elastic material, and a contact foil 17 are placed on the interior of the base 15 of the upper housing shell 3.

The two contact foils 14 and 17 in both housing shells 2 and 3 are connected to two terminal contacts 18 and 19 on the exterior of the housing shell 3. These terminal contacts are in the form of plug pins of which the plug pin 18 has an elongation 20 reaching through the housing shell 3 and the elastic strip 16 as well as through the contact foil 17 and electrically connects the plug pin 18 with the contact foil 17. For this purpose the contact foil 17 is securely clamped between a nut, screwed on to the elongation 20, and a bush 22 enveloping the elongation and resting on the base 15 of the housing shell 3.

The other plug pin 19 is electrically connected to a rod 23 on the exterior of the housing shell 3, against which rod the metallic underside of the screw-head, in the form of a knob, is pressed. The threaded pin 10 is in electrical contact with the contact foil 14 in the lower housing shell 2, but not, however, with the contact foil 17 in the upper housing shell 3, through which the threaded pin reaches to the exterior. The threaded pin 10 in this manner is used as an electrical conductor between the plug pin 19 on the exterior of the one housing shell 3 and the contact foil 14 in the other housing shell 2. The rod 23 on the exterior of the housing shell 3 reaches past the threaded pin 10 to the opposite narrow-side edge of the housing shell and thereby serves as a brace for the housing shell consisting of insulating material.

The distance between both contact foils 14 and 17 in both housing shells 2 and 3 is somewhat less than the length of the supporting slots 9 for the contact bars (not shown in the drawing) in the longitudinal sides 4 and 6 of both housing shells and reaching between the contact foils, so that even at varying height of the contact bars, due to the tolerances, a perfect electrical contact between the contact foils 14 and 17 and all the contact bars is ensured, because the strip of elastic material placed underneath the contact foils is pliable and compensates for the slight differences in height of the contact bars.

I claim:

1. Connecting part for warp stop motion, for conducting electrical current to several contact bars positioned parallel to each other and each consisting of two insulated current rails, including a first and a second housing shell, each with two longitudinal side frames with supporting slots at equal distances to take up the contact bars, and two narrow lateral side frames, are pressed against each other by means of a securing device, and that on the interior bases of both housing shells a strip of elastic material, covered by a contact foil or band, is attached for the purpose of conducting electrical current to all the contact bars, whereby the complementary distance of the two contact foils is less than the length of the supporting slots for the contact bars extending between them, and that terminal contacts on the exterior side of one housing shell are electrically connected to one each of the two contact foils on the interior bases of both housing shells.

2. Connecting part according to claim 1, wherein the securing device pressing the two housing shells against each other is a threaded pin screwed into the base of one of said housing shells and extending through to the exterior of the opposite housing shell, said pin having a screw head in the shape of a knob that, when the threaded pin is screwed into one housing shell, is pressed against the mentioned exterior of the opposite housing shell.

3. Connecting part according to claim 2, wherein one housing shell in which the threaded pin is screwed is of electricity-conducting material and the other housing shell is of non-conducting material and that the threaded pin, screwed into the housing shell of electricity-conducting material, serves as a current conductor between the contact foil which is in face contact with this shell and one of the terminal contacts on the exterior side of the housing shell of non-conducting material.

4. Connecting part according to claim 3, wherein the threaded pin is placed in the longitudinal center of the housing shells and the terminal contacts are placed at a lateral distance from the threaded pin and near one end of the housing shell of non-conducting material on its exterior side, and that this housing shell has a rod on the mentioned exterior side, through which the threaded pin reaches, and that this rod serves as current conductor to the electrical connection between the screw head of the threaded pin which, when the threaded pin is screwed tight, is pressed against the rod, and one terminal contact which is firmly fixed to the rod on the mentioned exterior side of the housing shell.

5. Connecting part according to claim 3, wherein a second terminal contact on the mentioned exterior side of the housing shell of non-conducting material, is connected to the contact foil on the interior of the same shell by means of a conductor extending through the base of the housing shell.

6. Connecting part according to claim 1, wherein the strip of elastic material is of a synthetic, cautchouc-elastical, material.

* * * * *